US005170995A

United States Patent [19]

Bitsch et al.

[11] Patent Number: 5,170,995

[45] Date of Patent: Dec. 15, 1992

[54] EASILY DISASSEMBLABLE COMPACT HOIST

[75] Inventors: Harald Bitsch, Witten; Heinz Flaig, Bochum; Heinz Hasselmann, Hagen, all of Fed. Rep. of Germany

[73] Assignee: Mannesmann Aktiengesellschaft, Düsseldorf, Fed. Rep. of Germany

[21] Appl. No.: 764,048

[22] Filed: Sep. 23, 1991

Related U.S. Application Data

[63] Continuation of Ser. No. 505,262, Apr. 4, 1990, abandoned.

[30] Foreign Application Priority Data

Apr. 4, 1989 [DE] Fed. Rep. of Germany ..... 3911292

[51] Int. Cl.[5] ..... B66D 1/14

[52] U.S. Cl. ..... 254/342; 254/380

[58] Field of Search ..... 254/270, 342, 361, 344, 254/333, 372, 380

[56] References Cited

U.S. PATENT DOCUMENTS

| | | | |
|---|---|---|---|
| 1,083,412 | 1/1914 | Shreve | 254/380 X |
| 1,187,669 | 6/1916 | Spaulding | 254/380 X |
| 1,596,269 | 8/1926 | Jimerson et al. | 254/344 |
| 1,945,712 | 2/1934 | Wadd | 254/342 X |
| 2,324,000 | 7/1943 | Johnston | 254/344 |
| 2,365,141 | 12/1944 | Sully | 254/380 X |
| 2,500,326 | 3/1950 | Shaff | 254/344 |
| 2,540,099 | 2/1951 | Christian | 254/362 X |
| 2,637,525 | 5/1953 | Lock | 254/372 X |
| 2,667,331 | 1/1954 | Robins et al. | 254/372 X |
| 2,698,732 | 1/1955 | Graham | 254/342 |
| 2,710,738 | 6/1955 | Wittberger | 254/362 X |
| 2,739,789 | 3/1956 | Smith | 254/344 |
| 2,773,668 | 12/1956 | Robins et al. | 254/372 |
| 2,781,671 | 2/1957 | Devonshire | 254/372 X |
| 3,362,685 | 1/1968 | Noye et al. | 254/342 |
| 3,380,713 | 4/1968 | Quayle | 254/372 X |
| 3,387,822 | 6/1968 | Burrows | 254/372 |
| 4,434,974 | 3/1984 | LaCount | 254/380 X |
| 4,605,111 | 8/1986 | Ohno et al. | 254/372 X |

*Primary Examiner*—Daniel P. Stodola
*Assistant Examiner*—Tony A. Gayoso
*Attorney, Agent, or Firm*—Nils H. Ljungman and Associates

[57] ABSTRACT

A compact hoist with a central hoist housing and an enclosed transmission located opposite a motor. The output shaft, of the motor, is guided coaxially through a transmission output shaft that is hollow and supports a sprocket wheel, or similar device, and receives power from the transmission. The hoist is particularly easy and economical to assemble, service and repair, and is flexible when in use. In a preferred embodiment, the motor shaft is mounted in a transmission cover opposite the motor and the transmission-output shaft is mounted, on one side in the wall of the hoist housing, and on the other side in an end plate of the motor. That configuration makes the invention particularly suitable for automatic assembly.

19 Claims, 9 Drawing Sheets

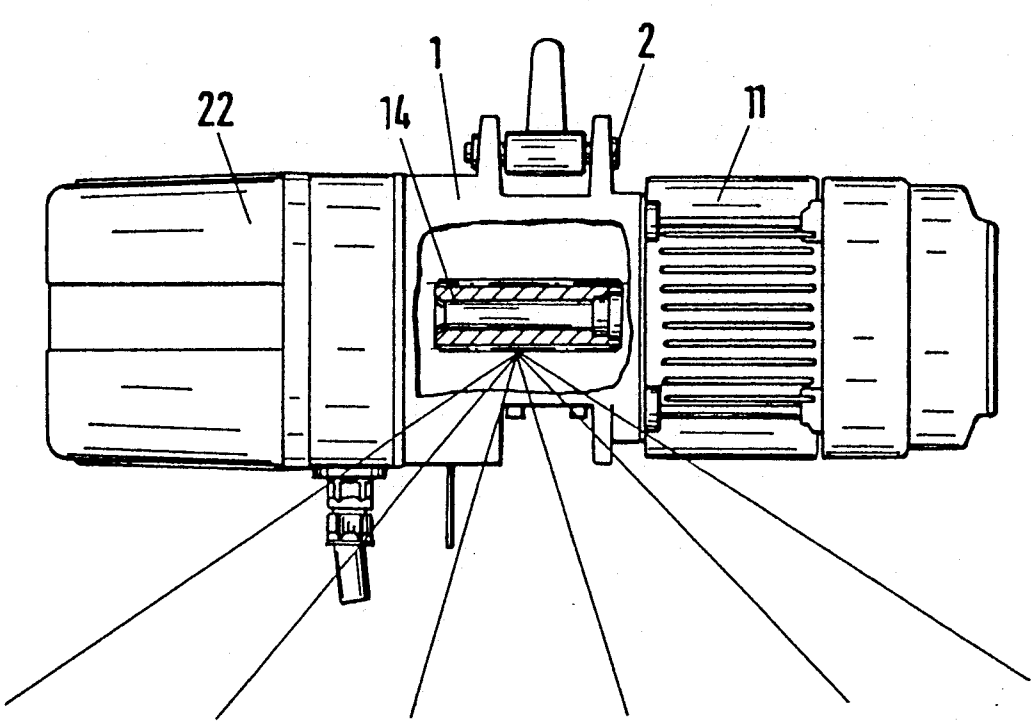
FIG. 1
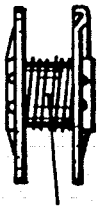
FIG. 15
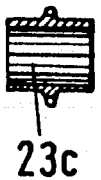
FIG. 16
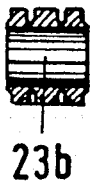
FIG. 17
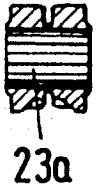
FIG. 18
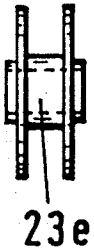
FIG. 19
FIG. 20

FIG. 4
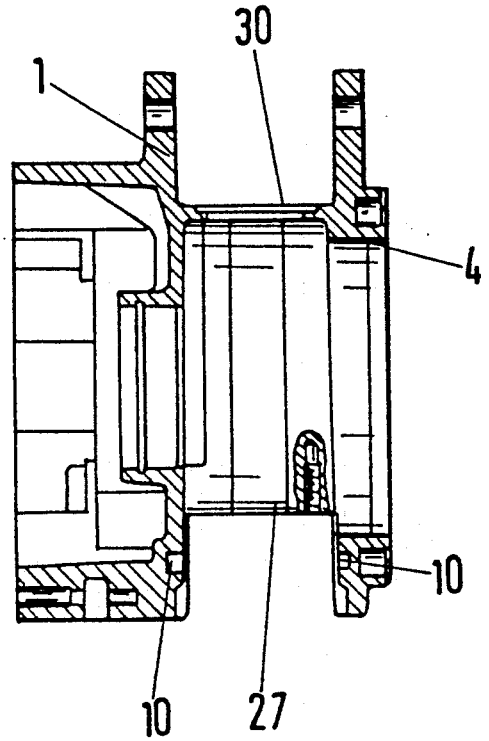
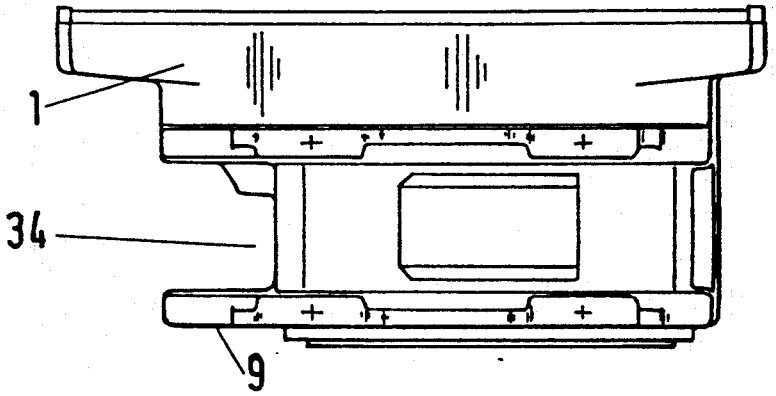
FIG. 5

EASILY DISASSEMBLABLE COMPACT HOIST

This application is a continuation of U.S. application Ser. No. 07/505,262, filed on Apr. 4, 1990, now abandoned.

BACKGROUND OF THE INVENTION

1. Field of the Invention

The present invention relates to a compact hoist that is configured for convenient assembly, disassembly and servicing and, more particularly, to a hoist having a sprocket, or other hoist wheel, that can be installed and removed without assembly and disassembly of the hoist transmission. Further, the present invention relates to a compact hoist that can employ a variety of differently configured sprockets or other hoist wheels.

2. Background of the Information

German Laid Open Patent No. 33 30 528 discloses an electrically operated compact chain hoist. The sprocket wheel of the hoist is located between the motor and the transmission of the hoist. With this design, the motor shaft and the drive shaft are coaxially positioned wherein the rapidly rotating outer drive shaft is powered by the slowly rotating inner output shaft. Although that design provides a good weight balance, there are, still, significant disadvantages. Some of the disadvantages include the lack of ease of assembly, lack of ease of maintenance, high replacement part costs for the parts subject to wear, and extremely low flexibility since the hoist cannot be equipped with winding devices other than a standard sprocket wheel or with larger sprocket wheel variants.

With that hoist, the sprocket wheel, which frequently becomes worn when subjected to intensive use, can only be replaced after dismantling the transmission and removing the motor. The transmission fluid must also be drained and then replaced.

When the sprocket wheel becomes worn, which occurs rapidly if the hoist is not lubricated regularly, the entire output shaft, which is designed as a single piece with the sprocket wheel, must be replaced. Since the housing acts as a chain guide and, therefore, narrowly encloses the sprocket wheel, varying designs of the sprocket wheel, e.g. sprocket wheels with a higher number of teeth or an increased diameter, or even the installation of cable drums which wind the cable in several layers, are not possible.

OBJECT OF THE INVENTION

One object of the invention, therefore, is to provide a hoist that eliminates these disadvantages. Other objects are to provide a compact hoist which is easy and economical to operate, install, assemble, service and repair, that is flexible in use and that is suitable for automatic assembly.

SUMMARY OF THE INVENTION

These objects are achieved by mounting the motor shaft, of the hoist, in the transmission cover, opposite the motor, and mounting one side of the transmission output shaft in the transmission-side wall of the hoist housing and the other side of the shaft on an end plate of the motor. Neither the motor nor the transmission need to be opened to remove the sprocket wheel. Further, because of the large assembly opening provided when the motor is removed, the sprocket wheel and/or the other winding device can be replaced without removing any additional parts. Only four motor flange bolts need to be removed to remove the sprocket. The time required to replace a sprocket wheel, with a bearing arrangement of the present invention, is only approximately 7 minutes while, on other chain hoists of the prior art, such an operation takes approximately ½ to 1 hour.

In another embodiment of the present invention, the center opening of the hoist housing is configured to mate with an end plate of the motor. The opening is larger than the diameter of the sprocket wheel or other winding device. Through this opening the sprocket wheel or other winding devices, that are mounted with a close sliding fit on an involute gearing with head centering of the transmission-output shaft, can be installed and removed.

In another embodiment of the invention, the hoist has an opening on the top that can be closed by a cover. Hoisting apparatus can, optionally, be routed outside the housing through that opening. On the outside of the transmission cover, there are, preferably, fastening surfaces for control elements such as terminal strips, flat connector blocks, rails for fastening protective elements, pulse generators and/or limit switches. Moreover, the hoist housing has various holes to accommodate the bolting-on of one of several sizes of motor. That results in a high degree of flexibility of output, i.e. load-carrying capacity and hoisting speed. Additional holes on the side of the hoist housing also make possible a lateral flange mounting of the hoist, which is advantageous in stationary operation or under certain installation conditions.

The hoist of the present invention, when the hoisting apparatus exits from the bottom, also has an attachment surface for the optional mounting of various guidance elements for the hoisting apparatus.

In still another embodiment of the present invention, the housing cover has insertion, or plug-in, openings in which various inserts for the electrical equipment installation can be form-fitted in any desired arrangement. Such electrical equipment may include power cables of various sizes, control cables including strain relief devices, plug-and-socket connections and limit switches. The system also provides for the lateral insertion of electrical equipment that is prefabricated and tested outside the hoist.

For the simple, direct mounting of limit switches for the hoist, holes are provided, on the underside of the hoist housing, into which fastening bolts can be directly inserted. As a result of the installation of direct-switching switch elements in the enclosed electrical equipment chamber, in addition to a high degree of electrical protection, it also becomes economically possible to provide a high degree of mechanical protection. With the present invention, externally-mounted levers actuate the direct-action switch elements via sealed rubber membranes. Such an arrangement makes it possible to eliminate the need for cable ducts, for external switches and the electrical control equipment can be installed completely pre-wired. The hoist housing also has a lateral recess in the vicinity of the exit of the hoisting apparatus, which makes it possible to deflect the hoisting apparatus approximately vertically upward, to get a better overall trolley length.

One aspect of the invention resides broadly in a hoist for moving a load. The hoist includes a motor having a first housing, a transmission having a second housing, a motor shaft having a first end, a transmission shaft having a second end and a third end, a wheel defining an external dimension and for being connected to the transmission shaft and a third housing for at least partially enclosing the wheel. The motor shaft is for being connected to the motor and the transmission and for transferring mechanical power from motor to the transmission. The transmission shaft is for being connected to the transmission and for receiving mechanical power from the transmission shaft and the wheel. The wheel receives mechanical power from transmission shaft. The first end of the motor shaft is for being rotatably mounted in the second housing of the transmission. The second end of the transmission shaft is for being rotatably mounted in the third housing. The third end of the transmission shaft is for being rotatably mounted in the first housing of the motor. The third housing defines an opening of a size that is larger than the external dimension of the wheel.

BRIEF DESCRIPTION OF THE DRAWINGS

The following Description of the Preferred Embodiments may be better understood when taken in conjunction with the appended drawings in which:

FIG. 1 is a side elevational view, partially in section of the present invention;

FIG. 4 is a sectional view of the present invention taken along line IV—IV in FIG. 3;

FIG. 5 is a top view of a portion of the present invention taken along line V—V in FIG. 3;

FIGS. 15–20 show various wheels that may be employed by the present invention.

DESCRIPTION OF THE PREFERRED EMBODIMENTS

Figure 2:
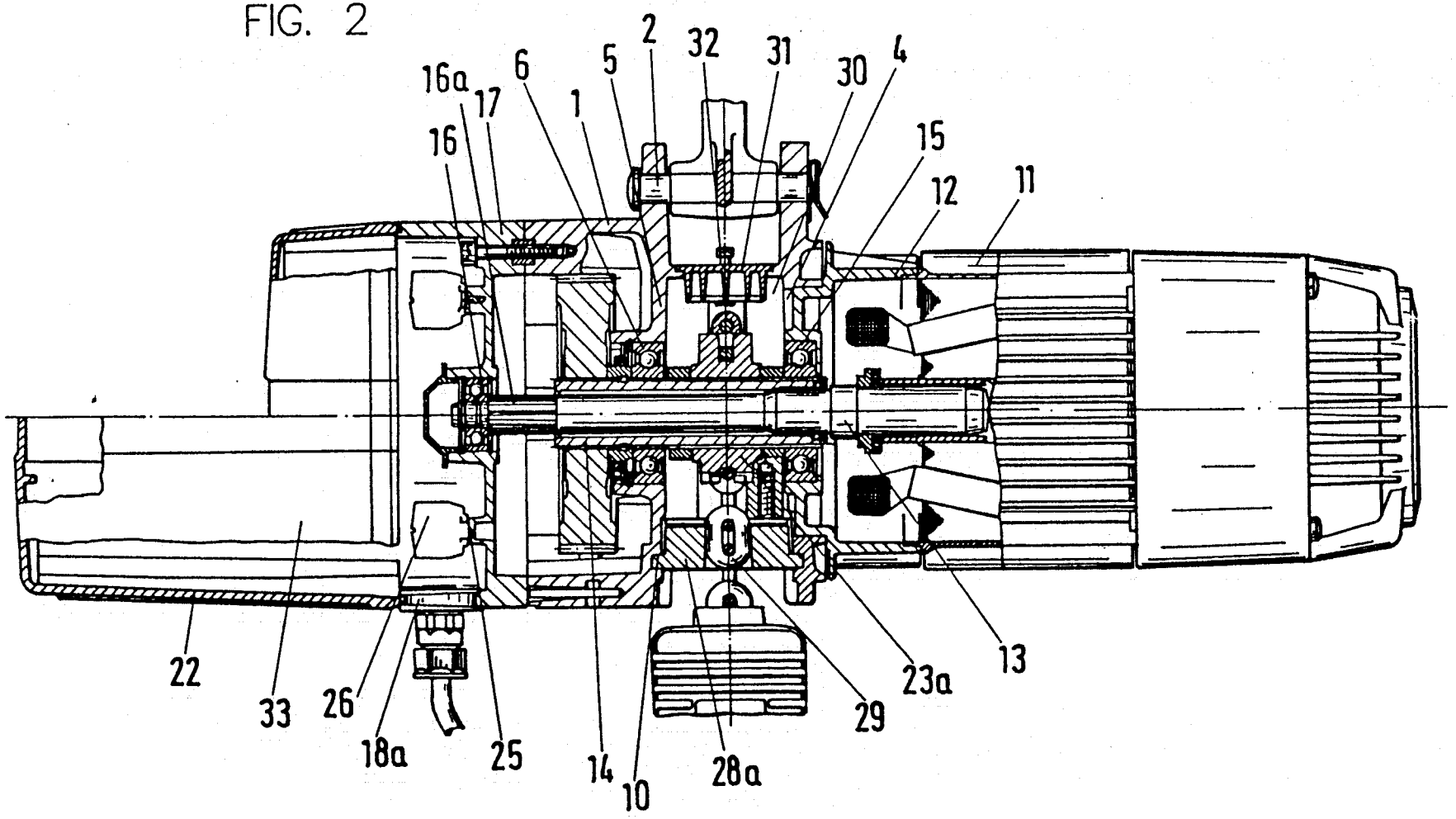
FIG. 2 is another side elevational view, partially in section, of the present invention.

As shown in FIG. 1, hoist housing 1, suspended by bolts 2, is positioned between motor 11 and transmission section with electrical cover 22. Positioned in hoist housing 1, is transmission-output shaft 14, which is provided for turning interchangeable winding devices. Depending on the users requirements, the winding devices may be any suitable wheel sheave, pulley, or the like, such as standard sprocket wheel 23*a*, double sprocket wheel 23*b*, roller chain sprocket wheel 23*c*, toothed belt roller 23*d*, flat cable drum 23*e* or round cable drum 23*f*, as shown in FIGS. 15 through 20.

Figure 3:
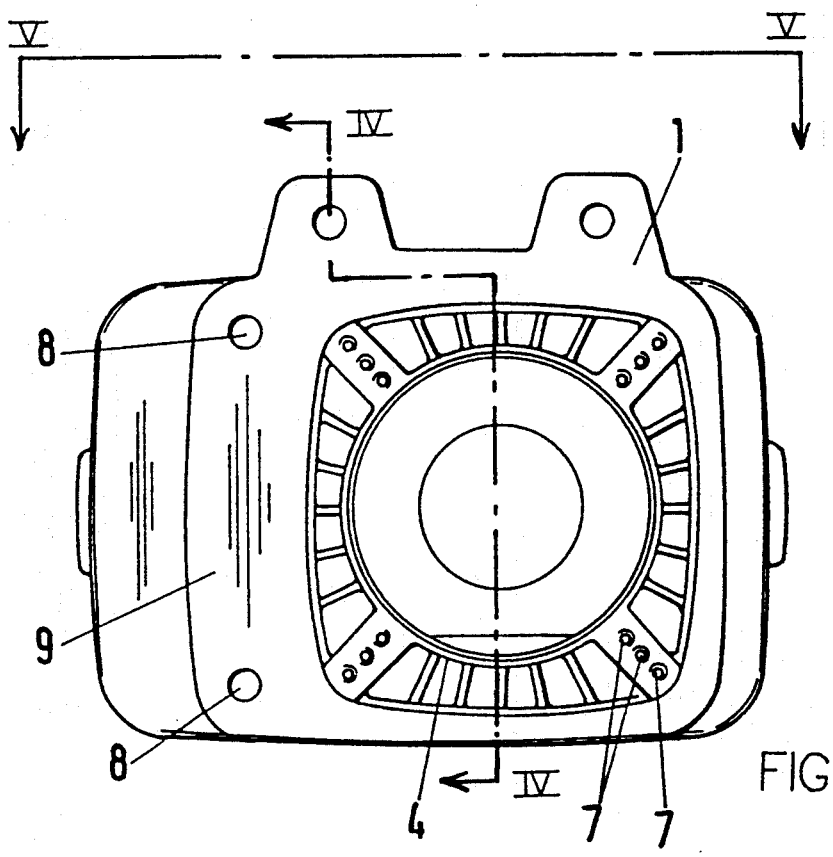
FIG. 3 is an end view of the present invention.

As shown in FIG. 2, hoist housing 1 has, on one side, housing wall 5, with bearing 6 for transmission output shaft 14, which supports sprocket wheel 23*a*. The other side of the housing has a large center opening 4, for mating with end plate 12 of motor 11, in which there is bearing 15 of transmission-output shaft 14. Transmission cover 17, which is bolted onto hoist housing 1, supports motor bearing 16 on the transmission-side end of motor shaft 13. As shown in FIG. 3, flange surface 9, of hoist housing 1 and center opening 4, have several threaded holes 7 for the connection of motors of various sizes. Flange surface 9, also, has two fastening holes 8 for the connection of the hoist to a support structure.

Figure 6:
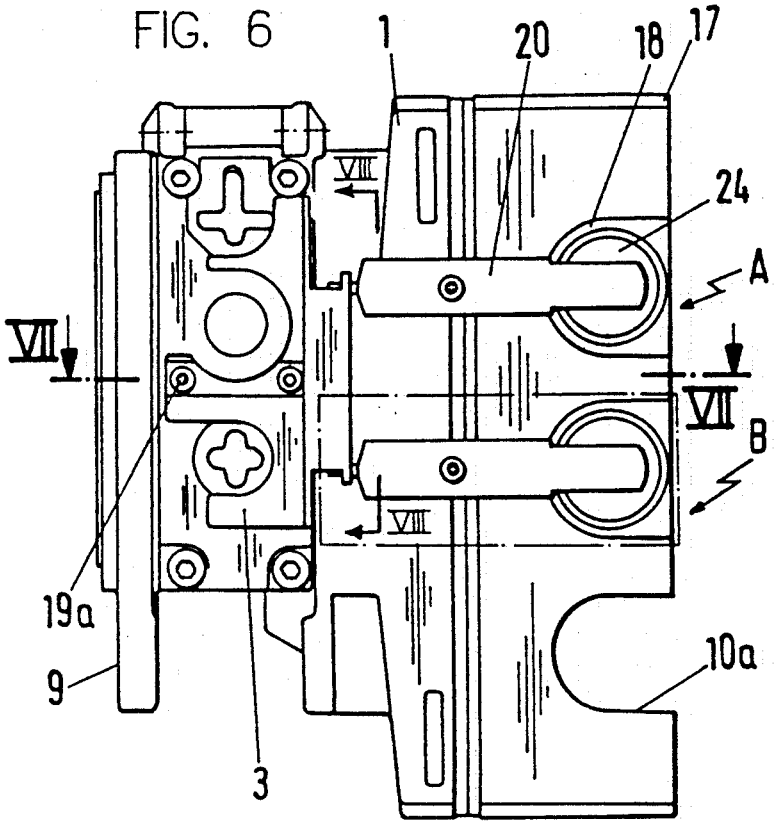
FIG. 6 is a bottom elevational view of a portion of the present invention and a limit switch installed therein.

As shown in FIGS. 2, 4 and 6, hoist housing 1, on the underside, has grooves 10 for the insertion of various guidance elements 28*a*, 28*b*, 28*c* and 28*d*, that are provided for guiding hoisting apparatus 29. In the embodiment illustrated in FIG. 2, for example, hoisting apparatus 29 is a chain. The hoist housing has opening 30 on the upper side for receiving insert 31 having support screw 32. Insert 31 is employed to prevent hoisting apparatus 29 from escaping from sprocket wheel 23*a*. Hoist housing 1 defines recess 34, as shown in FIG. 5, for guiding hoisting apparatus 29 as shown in see FIG. 10.

Figure 2A:
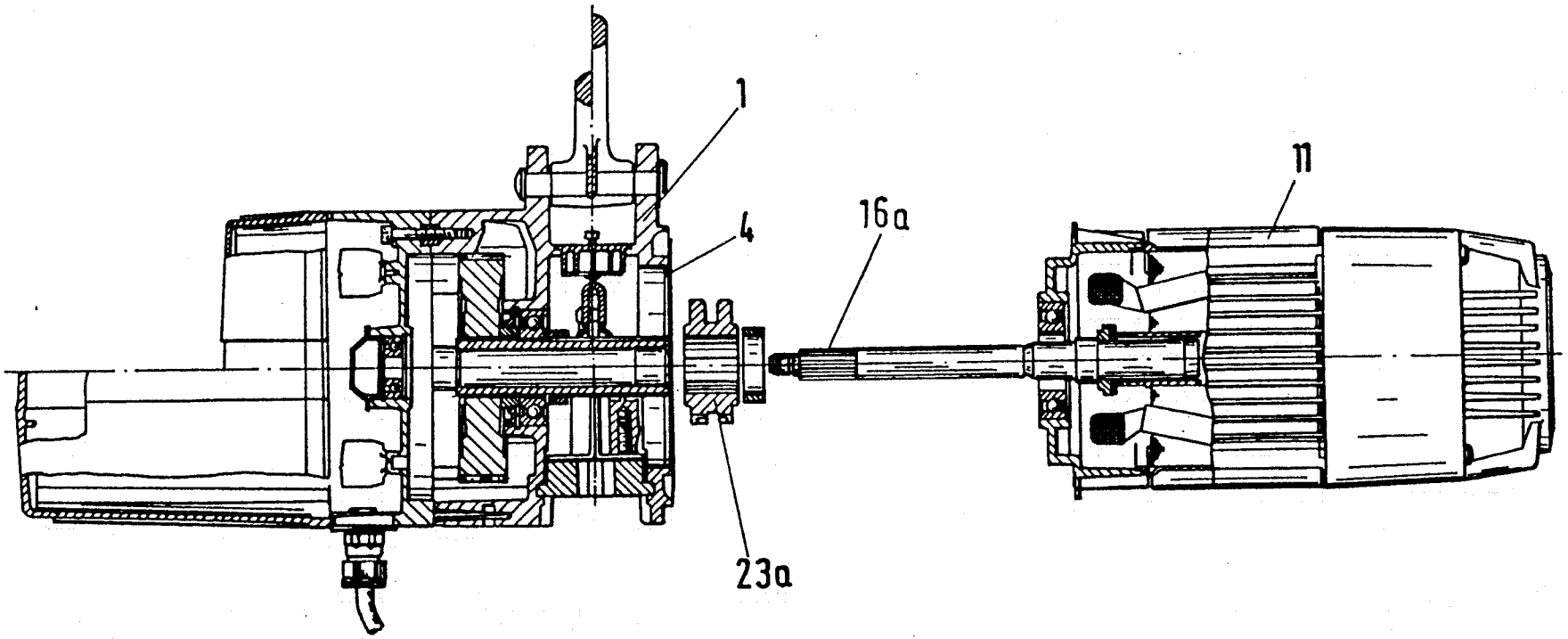
FIG. 2*a* is an exploded side elevational view, partially in section, of the present invention.

Transmission cover 17 has several fastening flanges 25 for control elements 26, which project inward into the electrical equipment space 33. Equipment space 33 is enclosed by electrical cover 22. Transmission cover 17, also, defines insert, or plug-in, openings 10*a* for receiving cables and inserts 18*b*. FIG. 2*a* shows motor 11 removed from hoist housing 1 and sprocket wheel 23*a* extracted from large, center opening 4.

Figure 8:
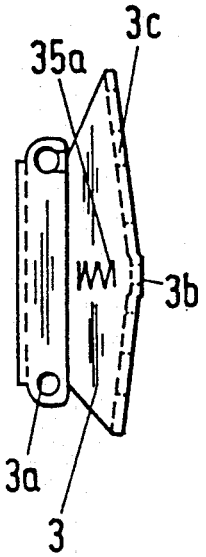
FIG. 8 is an enlarged sectional view of the rocker switch of the present invention taken along line VIII—VIII of FIG. 6.
Figure 7:
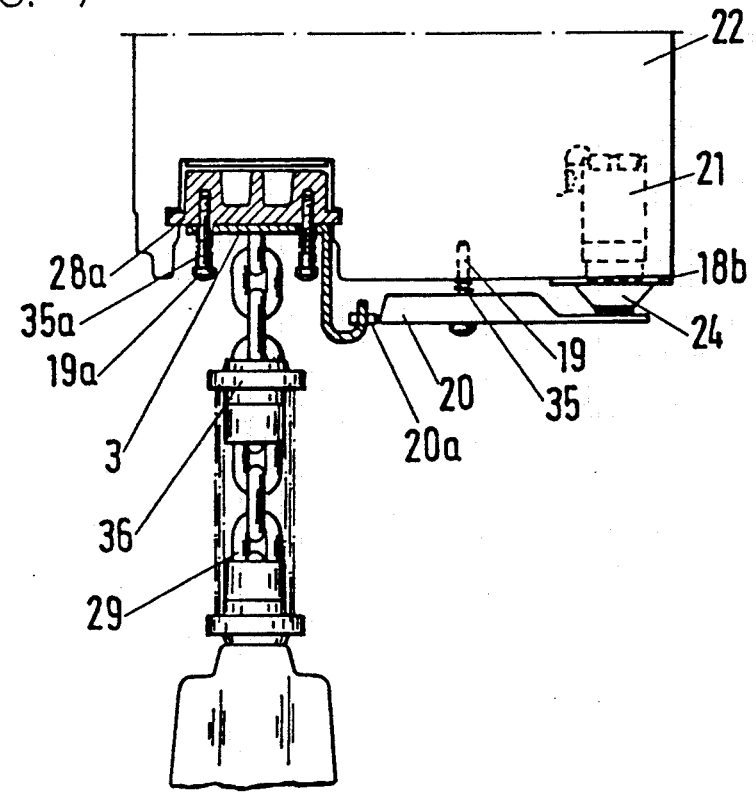
FIG. 7 is a sectional view of a portion of the present invention taken along line VII—VII in FIG. 6.

FIGS. 6 through 8 show the components of the limit switch, for upper hook position A and lower hook position B. Bolt 19 is bolted into hoist housing 1. Two-armed lever 20 is supported on one end of bolt 19 and, also, is held by spring 35. Lever 20 actuates switch elements 21. Switch elements 21 are equipped with rubber membranes 24 and are fastened by means of inserts, or plugs, 18*b* in transmission cover 17.

The two levers 20 project, by means of extensions 20*a*, into holes 3*a* of rocker switch 3. Rocker switch 3 is held in contact, by springs 35*a*, with contact surface 3*b*, as shown in FIG. 8. Switch 3 is supported on guide element 28*a*, for hoisting apparatus 29, by springs 35*a*, which are in contact with the heads of bolts 19*a*. Actuation surfaces 3*c*, of rocker switch 3, are cambered and facilitate the alternating actuation of the switch elements when switching contacts 36, of hoisting apparatus 29, have moved to the highest or lowest load position.

Figure 9:
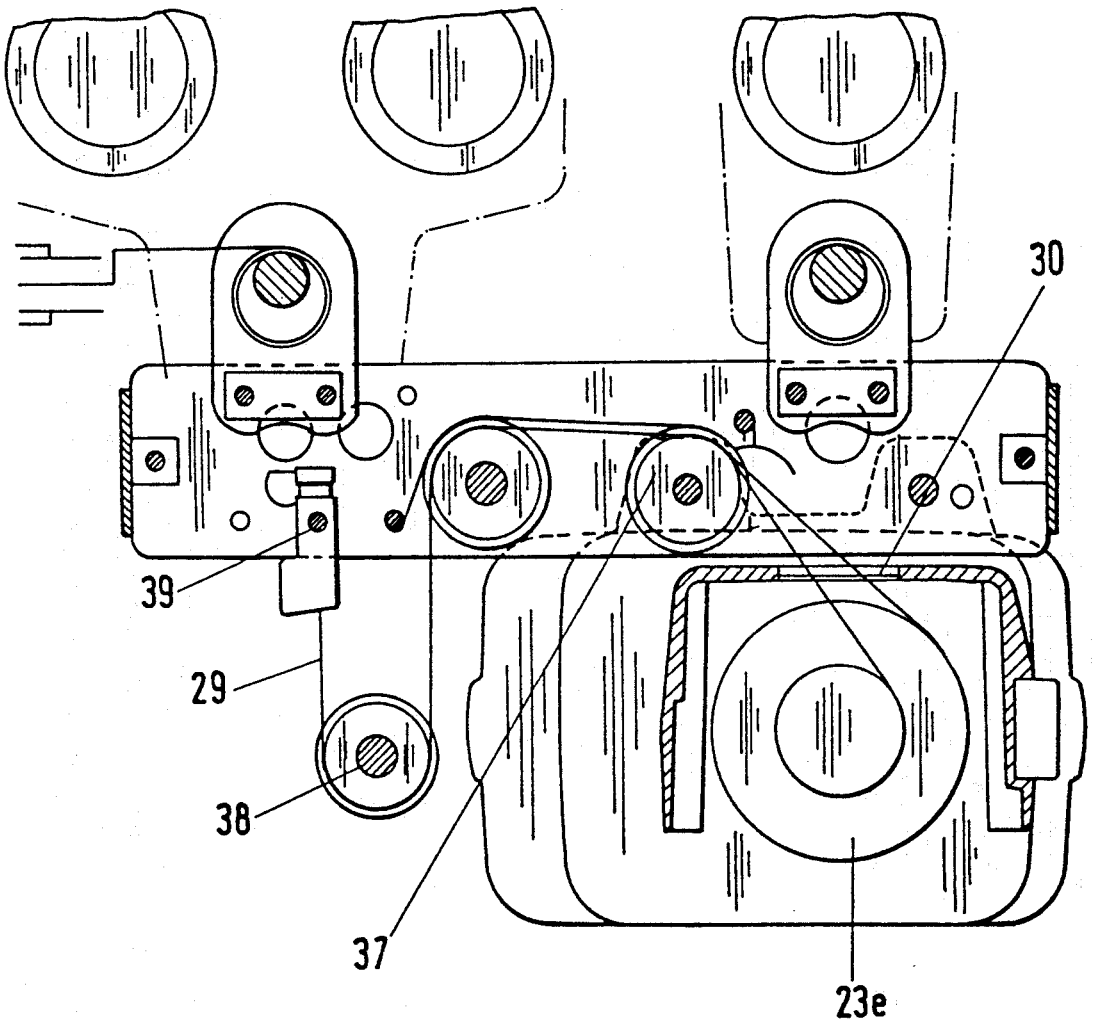
FIG. 9 is a sectional front elevational view of the present invention suspended by a trolley.

FIG. 9 shows the hoist on a short, overhead trolley, whereby hoisting apparatus 29 is guided from flat rope drum 23*e*, through upper opening 30, around deflector rollers 37 and lower flange 38, to fixed point 39.

Figure 10:
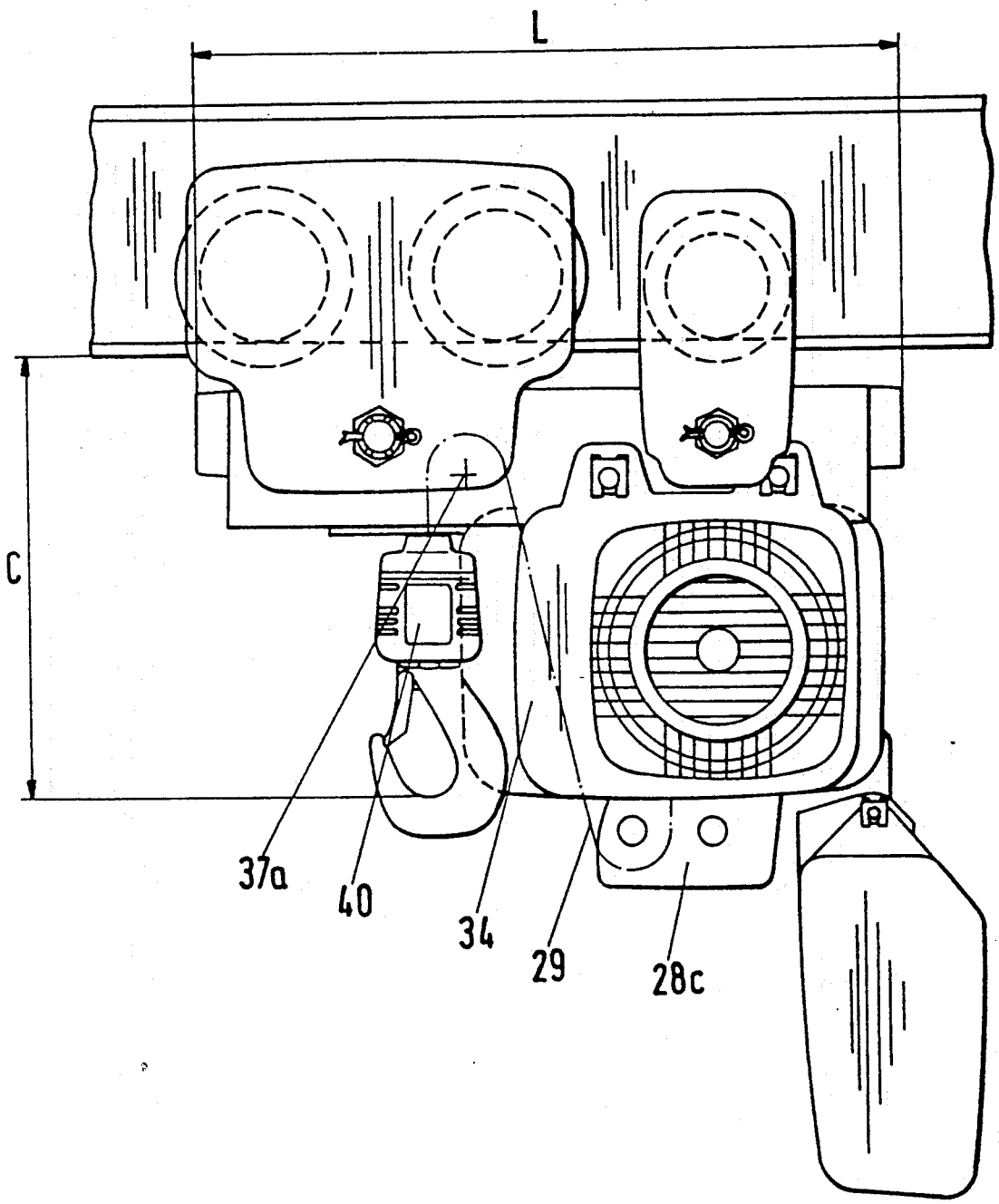
FIG. 10 is another sectional front elevational view of the present invention suspended by a trolley.
Figure 11:
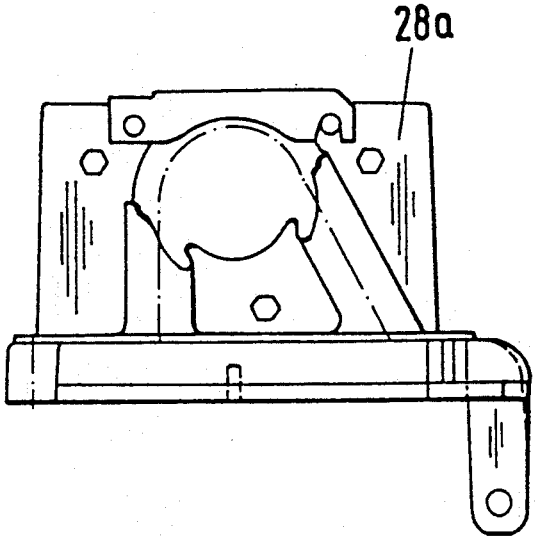
FIGS. 11–14 are side elevational views of the hoisting apparatus guides employed in the present invention.
Figure 12:
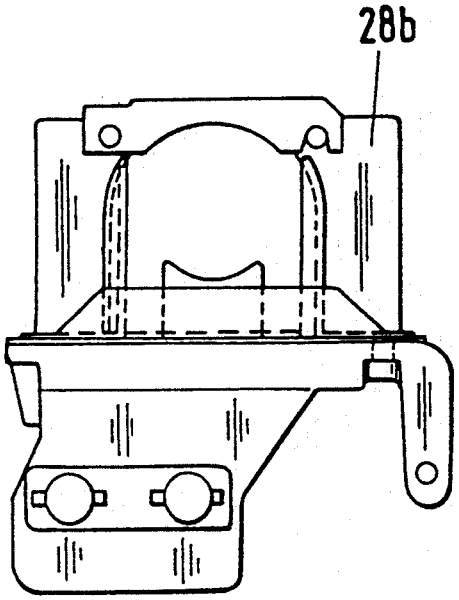
Figure 13:
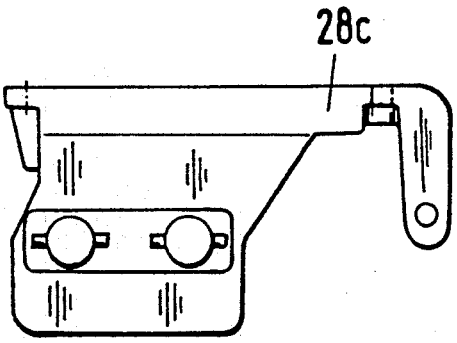
Figure 14:
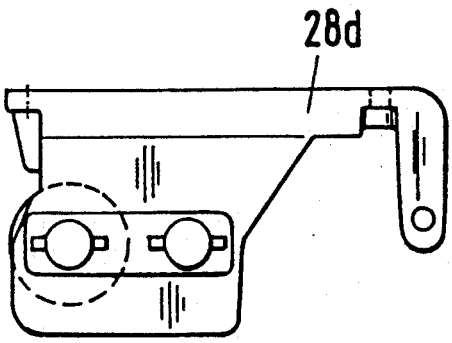

In the embodiment illustrated in FIG. 10, the bottom of the hoist housing includes chain deflector element 28*c*. From that position, hoisting apparatus 29 runs through recess 34, around deflector roller 37*a* (position shown) to load hook 40. Load hook 40 can be pulled close to the hoist, since starting distances C and L are small.

FIGS. 11 through 14 show single chain guide element 28*a*, double chain guide element 28*b*, chain deflector element 28*c* and idler roller element 28*d* for a flat rope, or belt.

In summary, one feature of the invention resides broadly in a compact hoist with a central hoist housing and a enclosed transmission located opposite a motor, with a motor shaft guided coaxially through a transmission output shaft designed as a hollow shaft and supporting a sprocket wheel or similar device leading to the transmission, characterized by the fact that the motor shaft 13 is mounted in a transmission cover 17 opposite the motor 11, and that the transmission drive shaft 14 is mounted on one hand in the wall 5 of the hoist housing 1 and on the other hand in an end plate 12 of the motor 11, and a center opening 4 of the hoist housing 1 for the end plate 12 of the motor 11 is larger than the diameter of the sprocket wheel 23*a* or of another winding device 23*b* to 23*f*.

Another feature of the invention resides broadly in a compact hoist, characterized by the fact that the transmission drive shaft 14, at least in the vicinity of the sprocket wheel 23*a* or of another winding device 23*b* to 23*f* and of a motor-side transmission bearing 15, has an involute toothing 16*a* with head centering and close sliding fit.

Yet another feature of the invention resides broadly in a compact hoist, characterized by the fact that the hoist housing 1, on the top, has an opening 30 which can be closed by an insert 31, through which the rope means can optionally exit.

A further feature of the invention resides broadly in compact hoist, characterized by the fact that on the outside of the transmission cover 17 there are fastening flanges 25 for control elements 26 such as terminal strips, flat connector blocks, fastening rails.

A yet further feature of the invention resides broadly in a compact hoist, characterized by the fact that the hoist housing 1 on the side on which the rope means exit has a connecting surface 27 for the mounting of various guidance elements 28*a* to 28*d* for the rope means.

Yet another further feature of the invention resides broadly in a compact hoist, characterized by the fact that the hoist housing 1 on the motor side has several threaded holes 7 for the installation of motors of different sizes.

An additional feature of the invention resides broadly in a compact hoist, characterized by the fact that the hoist housing 1 has additional fastening holes 8 and a flange surface 9.

A yet additional feature of the invention resides broadly in a compact hoist, characterized by the fact that the transmission cover 17 has insertion openings in the bottom to accept various inserts 18*a* and 18*b*.

A further additional feature of the invention resides broadly in a compact hoist, characterized by the fact that the hoist housing 1 has holes for bolts 19 for the optional mounting of levers 20 for the actuation of electrical switch elements 21, e.g. limit switches.

A yet further additional feature of the invention resides broadly in a compact hoist, characterized by the fact that the switch elements 21 for the limit switch functions are located inside an equipment space 33, formed by the transmission cover 17 and an electrical cover 22, and can be actuated from outside via sealed rubber membranes 24 by means of the levers 20.

Another further additional feature of the invention resides broadly in a compact hoist, characterized by the fact that the hoist housing 1 has a recess 34 on the side for the feed-through of a deflected rope means.

Some examples of involute gears and gear teeth can be found in U.S. Pat. No. 4,896,567, entitled "Planetary Transmission Mechanism and Device of Involute Gears with Complex Minor Tooth Difference"; U.S. Pat. No. 4,833,836, entitled "Process for Grinding a Gear Tooth Blank to Form an Involute Gear Tooth"; U.S. Pat. No. 4,815,239, entitled "Apparatus for Production of Involute Gear Tooth Flanks"; U.S. Pat. No. 4,565,474, entitled "Method of Generating Involute Tooth Forms with a Milling Cutter"; U.S. Pat. No. 4,512,109, entitled "Rolling Gear Apparatus for an Involute Tooth Gear Cutting Machine"; U.S. Pat. No. 4,467,568, entitled "Generating Method for the Chip-Producing Machining of Involute Tooth Flanks with Profile and Longitudinal Corrections"; U.S. Pat. No. 4,322,889, entitled "Testing Apparatus for Involute and Helical Gear Teeth" and U.S. Pat. No. 4,062,125, entitled "Apparatus for Testing the Tooth Flanks of Involute Gearing."

All, or substantially all, of the components and methods of the various embodiments may be used with at least one embodiment or all of the embodiments, if any, described herein.

All of the patents, patent applications, and publications recited herein, if any, are hereby incorporated by reference as if set forth in their entirety herein.

The details in the patents, patent applications, and publications may be considered to be incorporable, at applicant's option, into the claims during prosecution as further limitations in the claims to patentably distinguish any amended claims from any applied prior art.

The invention as described hereinabove in the context of the preferred embodiment is not to be taken as limited to all of the provided details thereof, since modifications and variations thereof may be made without departing from the spirit and scope of the invention.

What is claimed is:

1. A hoist for moving a load, said hoist comprising:

a motor having a motor housing;

a transmission being at least partially enclosed by a transmission housing;

a motor shaft;

a transmission shaft;

a wheel being at least partially enclosed by a wheel housing;

said wheel defining an external dimension;

connecting means for connecting said wheel to said transmission shaft;

said motor shaft for being connected to said motor and said transmission;

said motor shaft being fixedly connected to said motor;

said motor shaft for transferring mechanical power from said motor to said transmission;

said transmission shaft for being connected to said transmission and said wheel;

said transmission shaft for receiving mechanical power from said transmission;

said wheel for receiving mechanical power from said transmission shaft;

said motor shaft having an end for being rotatably mounted in said transmission housing;

said transmission shaft having a first end for being rotatably mounted in said wheel housing;

said transmission shaft having a second end for being rotatably mounted in said motor housing;

said wheel housing defining an opening;

said wheel housing opening being of a size that is larger than said external dimension of said wheel;

said transmission shaft defining an interior cavity for receiving said motor shaft;

said transmission shaft interior cavity extending along an axis between said ends of said transmission shaft;

said wheel being movable through said wheel housing opening in a direction along said transmission shaft axis for positioning said wheel on said transmission shaft such that said connecting means connects said wheel to said transmission shaft;

said wheel being movable through said wheel housing opening in a direction along said transmission shaft axis for removing said wheel from said transmission shaft;

said motor housing being disposed on one side of said wheel housing; and said transmission housing being disposed on and connected to another side of said wheel housing;

fastening means for connecting said motor housing to said wheel housing such that said motor shaft extends through said transmission shaft interior cavity and into said transmission housing; and fastening means for disconnecting said motor housing from said wheel housing and for moving, as an integral unit, said motor and said motor shaft away from said wheel housing, such that said motor and said motor shaft move in unison away from said wheel housing;

whereby said wheel can be withdrawn from within said wheel housing through said wheel housing opening.

2. The hoist of claim 1, said hoist additionally comprising:

an end plate provided on said motor housing, said end plate having an outstanding raised portion provided thereon, said outstanding raised portion of said end plate being bounded by a peripheral wall, the configuration of said peripheral wall being substantially the same as the configuration as the periphery of said wheel housing opening, whereby said outstanding raised portion of said end plate is engaged within said wheel housing opening when said motor housing is connected to said wheel housing by said means for connecting;

wherein said means for connecting comprises two holes formed in said end plate of said motor housing surrounding said outstanding raised portion, two corresponding holes formed in said wheel housing, and two threaded fasteners, one each of said two threaded fasteners being for engagement with one each of said two holes formed in said motor housing and said wheel housing, respectively; and a first pair of flange members extending from said one side of said wheel housing, and a second pair of flange members extending from said another side of said wheel housing, each one of said first and second pairs of flange members being provided with a throughgoing hole.

3. The hoist of claim 1, including a hoisting means for moving the load, wherein said hoisting means comprises at least one of: a) a chain, b) a rope, c) a belt, d) a wire and e) a cable.

4. The hoist of claim 3, wherein said wheel comprises at least one of: a) a sprocket, b) a double sprocket, c) a pulley, d) a sheave, e) a drum, f) a toothed belt roller, g) a flat cable drum, h) a round cable drum, and i) a roller chain sprocket.

5. The hoist of claim 4, further including deflector means for defining a path of travel of said hoisting means, wherein said deflector means comprises at least one of: a) a single chain guide element, b) a double chain guide element, c) a chain deflection element, and d) an idler roller element.

6. The hoist of claim 5, wherein said transmission shaft comprises involute gearing with head centering to facilitate said connection of said wheel to said transmission shaft by said connecting means.

7. The hoist of claim 6, said hoist additionally comprising:

an end plate provided on said motor housing, said end plate having an outstanding raised portion provided thereon, said outstanding raised portion of said end plate being bounded by a peripheral wall, the configuration of said peripheral wall being substantially the same as the configuration as the periphery of said wheel housing opening, whereby said outstanding raised portion of said end plate is engaged within said wheel housing opening when said motor housing is connected to said wheel housing by said means for connecting;

wherein said means for connecting comprises two holes formed in said end plate of said motor housing surrounding said outstanding raised portion, two corresponding holes formed in said wheel housing, and two threaded fasteners, one each of said two threaded fasteners being for engagement with one each of said two holes formed in said motor housing and said wheel housing, respectively;

a first pair of flange members extending from said one side of said wheel housing, and a second pair of flange members extending from said another side of said wheel housing, each one of said first and second pairs of flange members being provided with a throughgoing hole;

an aperture formed in said wheel housing for receiving said deflector means; and a recess formed in said wheel housing for receiving said guidance means.

8. The hoist of claim 5, wherein said wheel is positioned between said motor and said transmission.

9. The hoist of claim 8, wherein said wheel housing defines aperture means for facilitating access to said wheel.

10. The hoist of claim 9, wherein:

said hoisting means is for being at least partially wound around said wheel;

said hoisting means is for being connected to the load to be moved; and said hoisting means is for moving the load.

11. The hoist of claim 10, wherein said hoisting means is configured to pass through said aperture means of said wheel housing.

12. The hoist of claim 11, further including control means for being connected to sand controlling said hoist.

13. The hoist of claim 12, wherein said transmission housing is configured to support said control means.

14. The hoist of claim 13, further including:

guidance means for guiding said hoisting means; and said wheel housing being configured to support said guidance means.

15. The hoist of claim 14, wherein said wheel housing is configured to support a plurality of sizes of motors.

16. The hoist of claim 15, wherein said wheel housing is configured to be attached to an external support.

17. The hoist of claim 16, wherein:

said control means includes switch means for controlling said motor means; and said switch means includes and is operated by a lever.

18. The hoist of claim 17, wherein said wheel housing is configured to support said lever.

19. The hoist of claim 18, wherein:

said control means includes an electrical component storage box;

said transmission housing and a cover comprise said electrical component storage box;

said switch means is at least partially positioned within said electrical component storage box;.

said lever and said switch are positioned between a sealing membrane;

said lever mechanically acts on said sealing membrane; and said sealing membrane mechanically acts on and operates said switch means.

* * * * *